US008217282B2

(12) United States Patent
Asada

(10) Patent No.: US 8,217,282 B2
(45) Date of Patent: Jul. 10, 2012

(54) COMBINATION SWITCH

(75) Inventor: Makoto Asada, Yao (JP)

(73) Assignee: Hosiden Corporation, Osaka (JP)

( * ) Notice: Subject to any disclaimer, the term of this patent is extended or adjusted under 35 U.S.C. 154(b) by 264 days.

(21) Appl. No.: 12/784,833

(22) Filed: May 21, 2010

(65) Prior Publication Data

US 2010/0300851 A1 Dec. 2, 2010

(30) Foreign Application Priority Data

Jun. 2, 2009 (JP) ..... 2009-133299

(51) Int. Cl.
*H01H 9/00* (2006.01)

(52) U.S. Cl. ..... 200/4; 200/14; 200/406

(58) Field of Classification Search ..... 200/4, 14, 200/406, 11 R–11 TC, 339, 5 R, 5 A, 17 R, 200/18; 341/35; 345/184
See application file for complete search history.

(56) References Cited

U.S. PATENT DOCUMENTS 6,111,208 A * 8/2000 Rochon et al. ..... 200/14
6,525,277 B2 * 2/2003 Oba et al. ..... 200/4
6,610,937 B2 * 8/2003 Yamaguchi ..... 200/4
6,680,444 B1 * 1/2004 Lee ..... 200/4
6,943,305 B2 * 9/2005 Kawamura et al. ..... 200/4
7,135,646 B2 * 11/2006 Tan ..... 200/4
7,262,373 B2 * 8/2007 Miura et al. ..... 200/4
7,498,527 B2 * 3/2009 Koizumi et al. ..... 200/5 R
7,635,817 B2 * 12/2009 Asada ..... 200/14
7,968,808 B2 * 6/2011 Yamanaka ..... 200/4
2008/0173522 A1 7/2008 Asada

FOREIGN PATENT DOCUMENTS

JP 2008159837 A 7/2008
JP 2008177098 A 7/2008

* cited by examiner

*Primary Examiner* — Michael Friedhofer
(74) *Attorney, Agent, or Firm* — The Webb Law Firm

(57) ABSTRACT

A rotary switch section R includes a brush unit 60 rotatably operated by a lever 72 and a plurality of fixed contacts. The brush unit 60 includes a pair of main contact shoes 62, 63 and a single auxiliary contact shoe 64. The fixed contacts include a main contact 24 with which the main contact shoes 62, 63 come into contact with the lever 72 is at its neutral posture N, a pair of contacts 25L, 25R with which the auxiliary contact shoe 64 comes into contact first when the lever 72 is rotatably operated, and second contacts 26L, 26R with which one of the main contact shoes 62, 63 comes into contact subsequently.

3 Claims, 8 Drawing Sheets

【Fig.1】
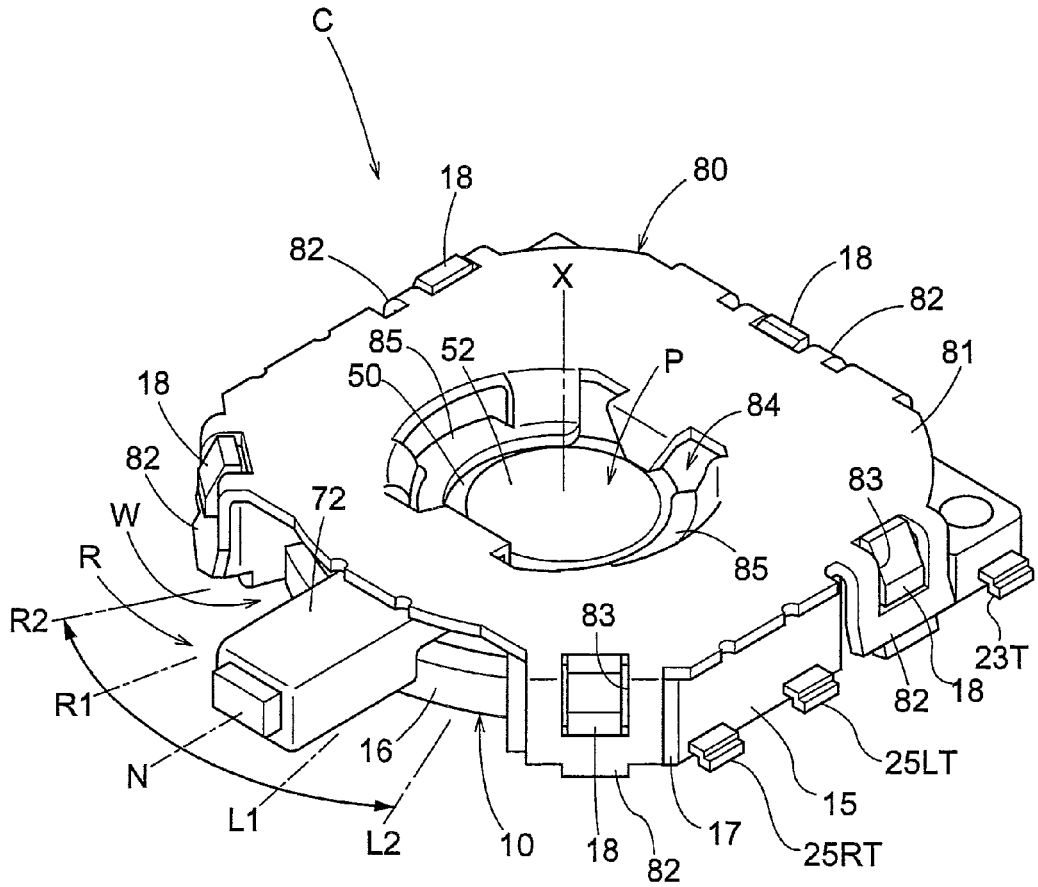

【Fig.2】
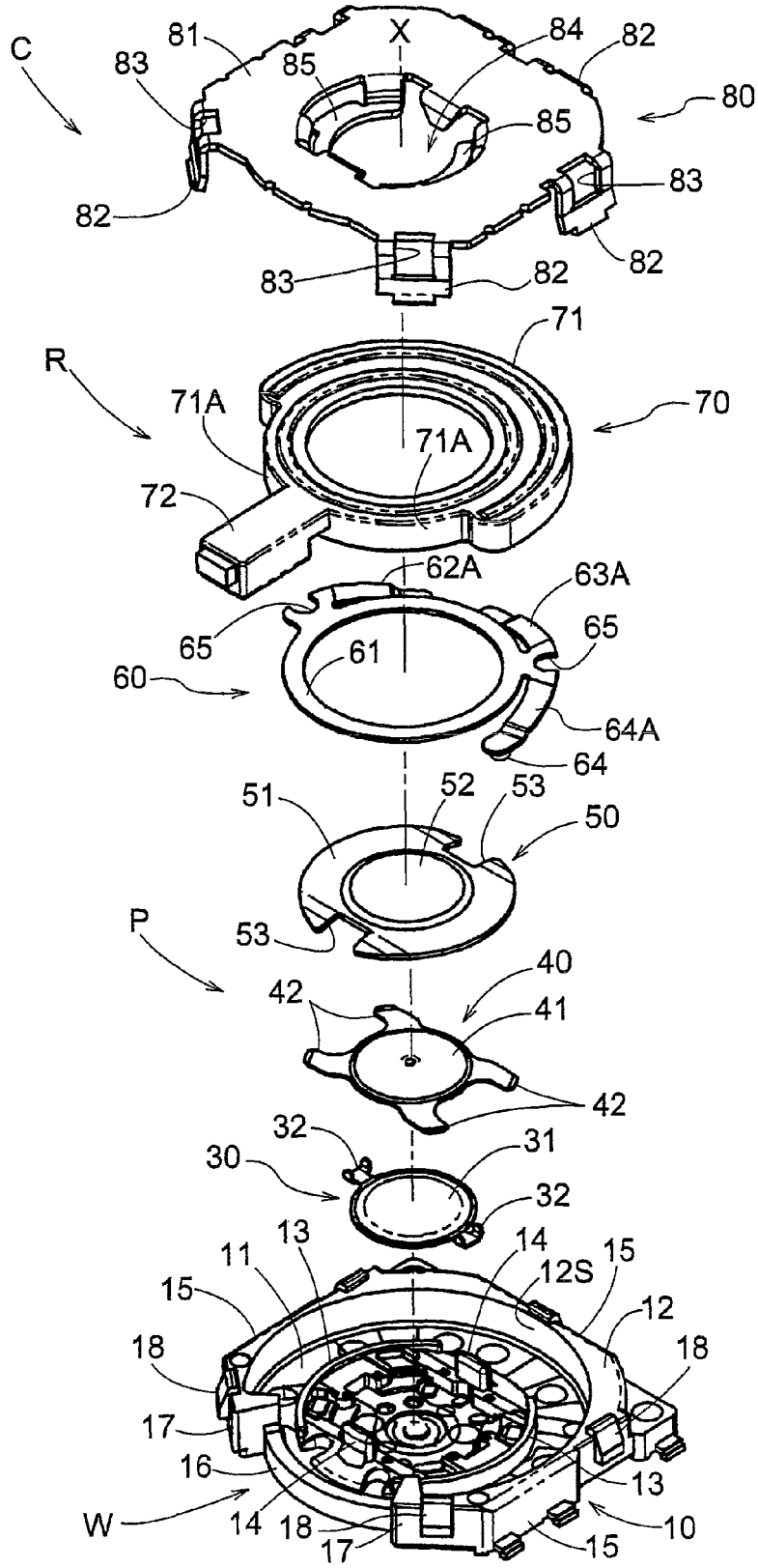

【Fig.3】
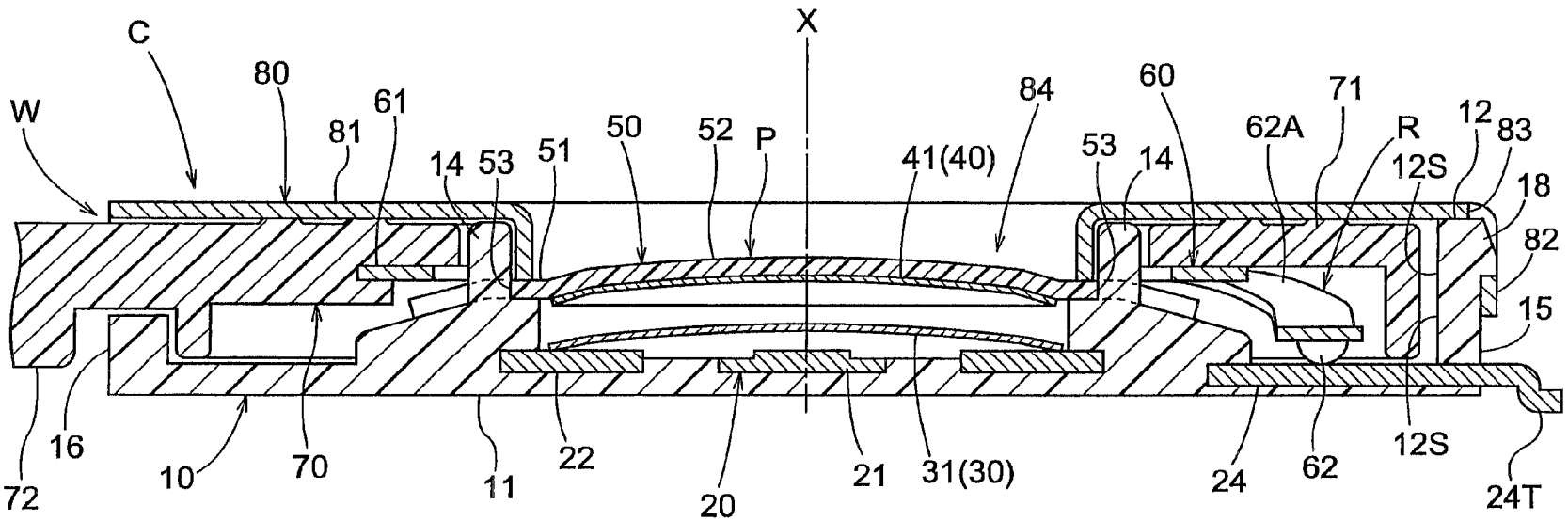

[Fig.4]
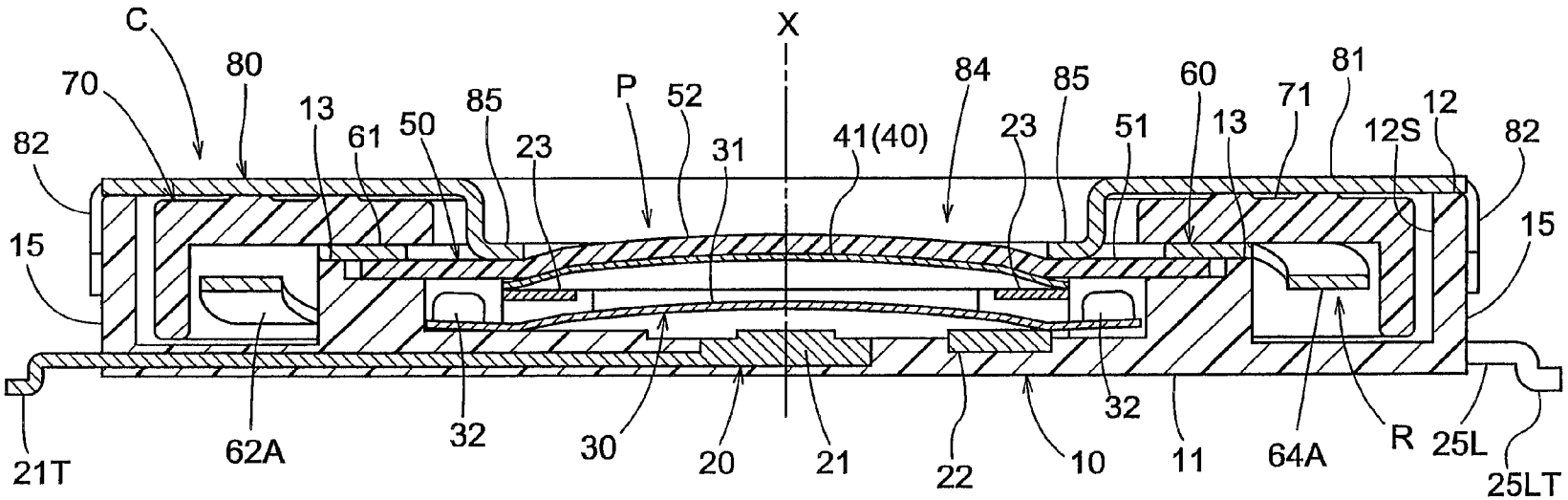

【Fig.5】
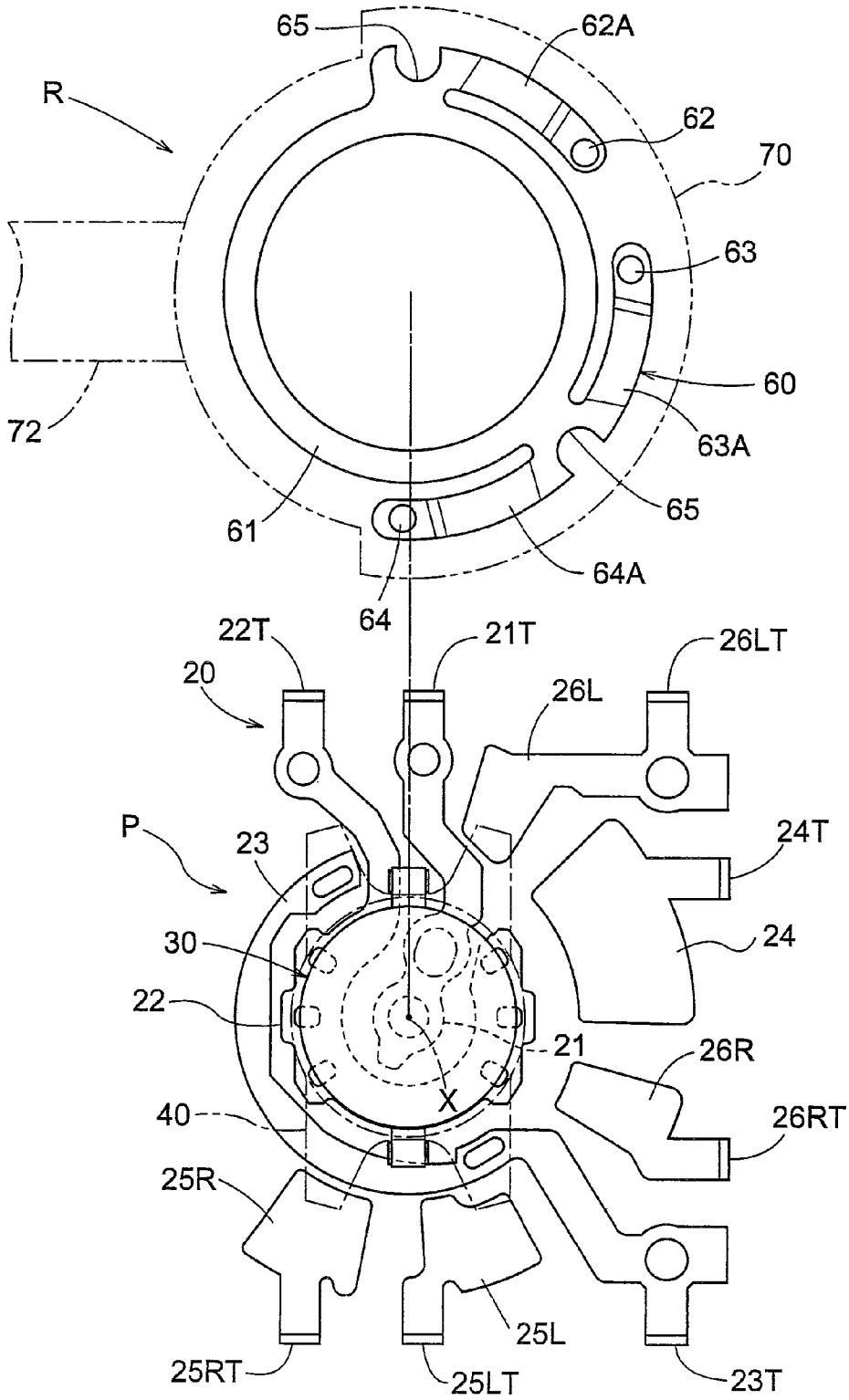

【Fig.6】
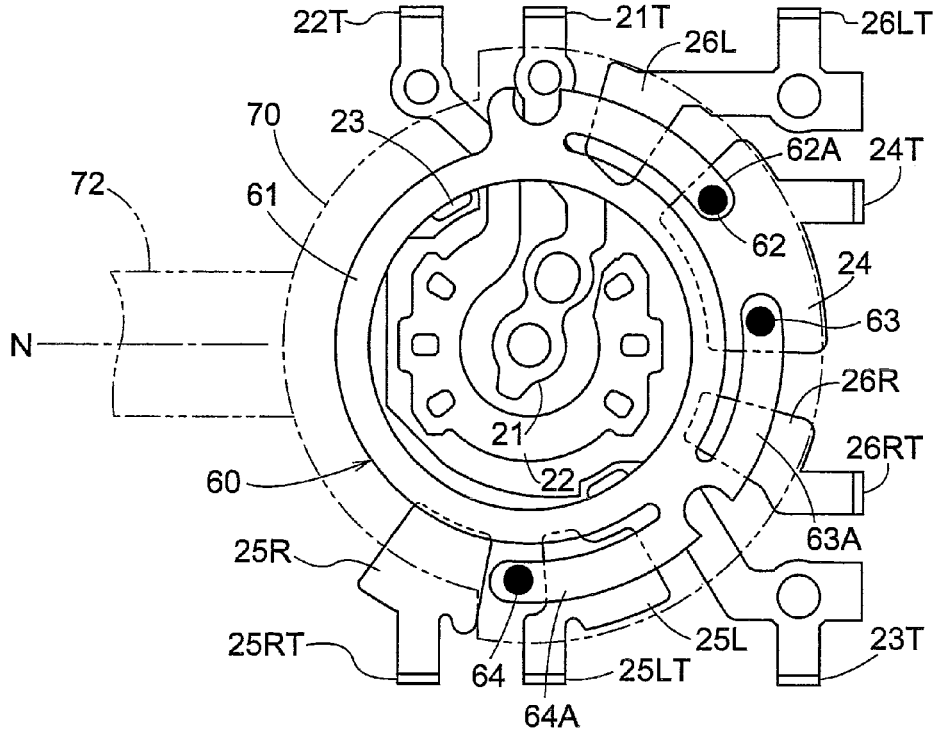
【Fig.7】
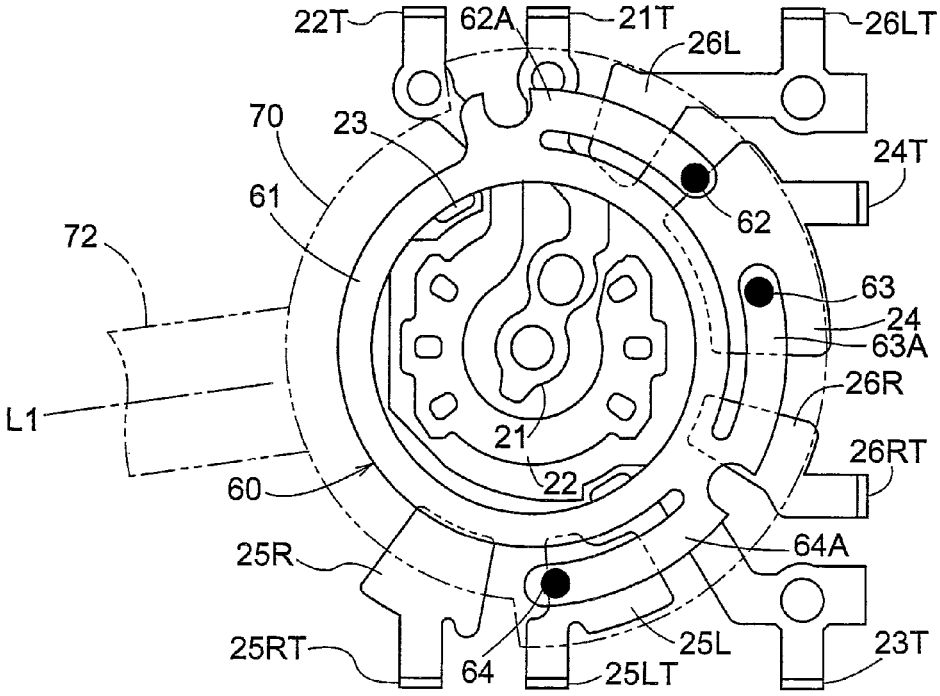

【Fig.8】
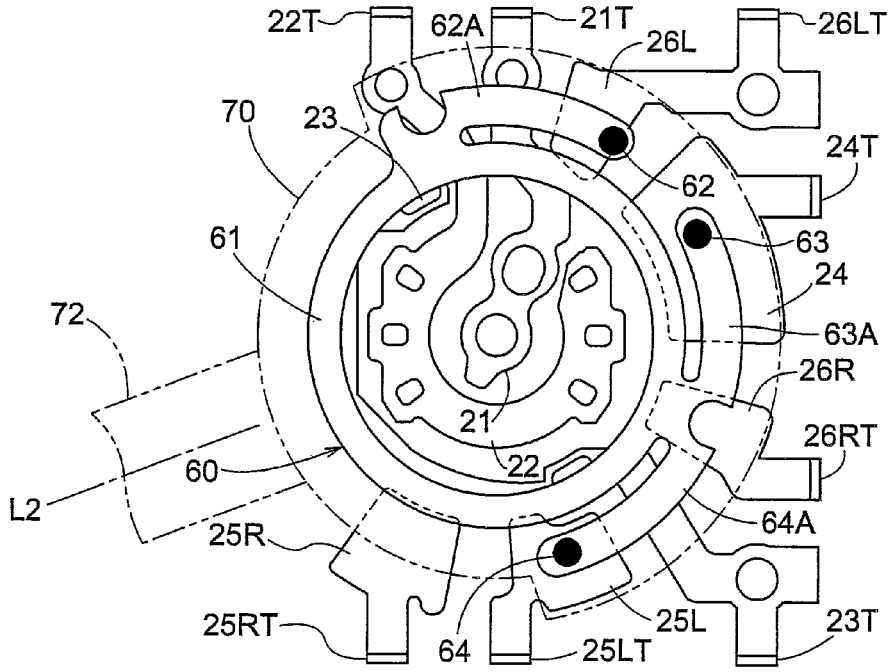
【Fig.9】
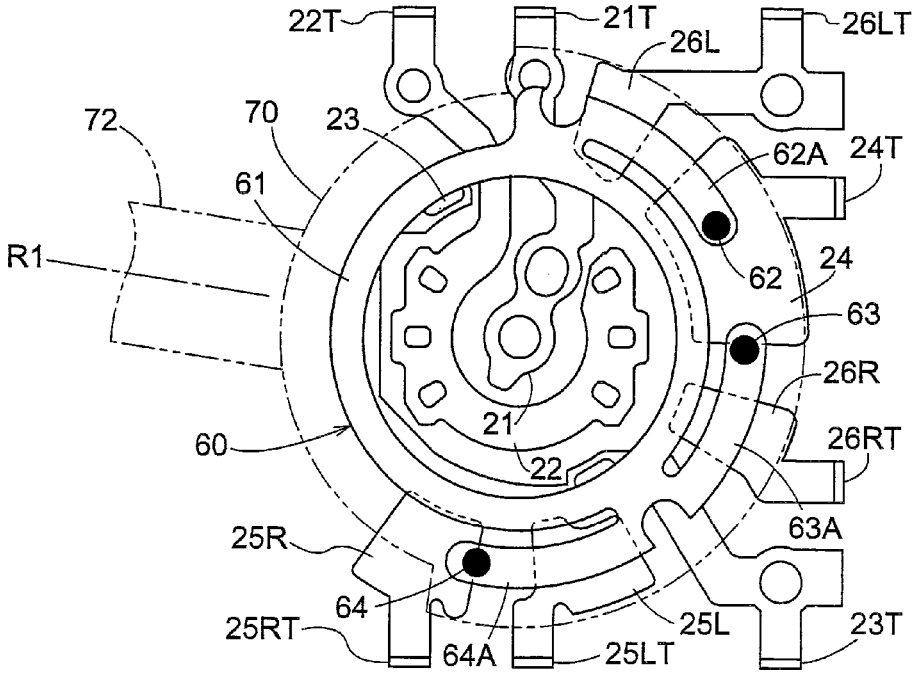

【Fig.10】
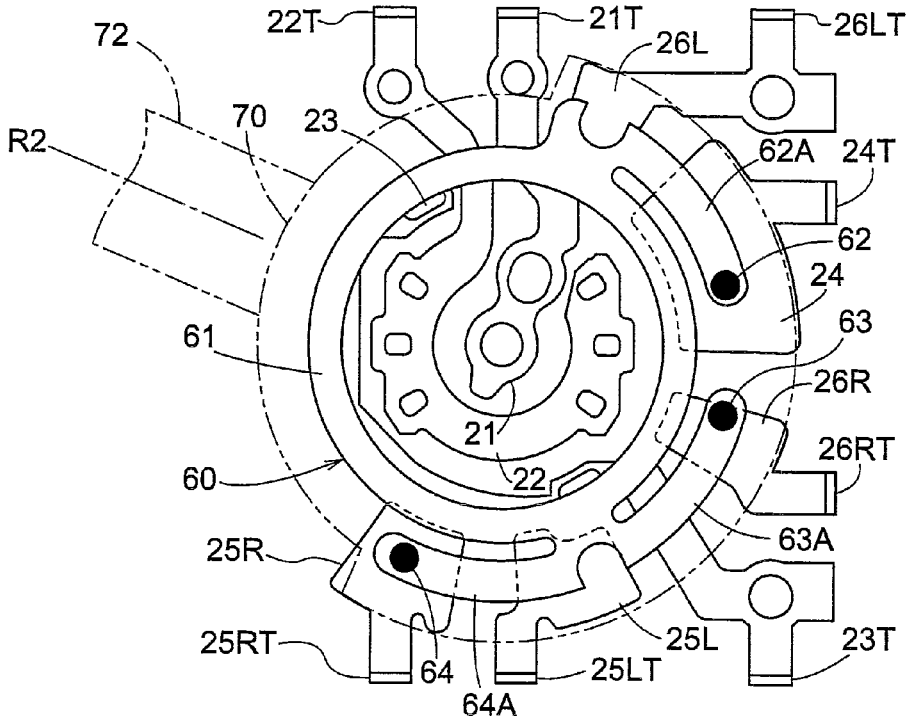

COMBINATION SWITCH

BACKGROUND OF THE INVENTION

1. Field of the Invention

The present invention relates to a combination switch including a push switch section having a contact plate elastically deformable with a pressing operation and a contacted point that enters into an electrically conductive state upon contact with the contact plate, the push switch section being configured to detect the pressing operation, and a rotary switch section having a brush unit comprised of a rotary conductive member rotatable about an axis with a lever operation and a plurality of contact shoes formed on the rotary conductive member and a plurality of fixed contacts electrically conductive with the plurality of contact shoes, the rotary switch section being configured to detect a rotary operation.

2. Description of the Related Art

A combination switch having the above-described construction is disclosed in Japanese Patent Application "Kokai" No. 2008-177098. This combination switch includes a lower main body and an upper frame. The push switch section is disposed at a position exposed through a hole defined at the center of the frame. The combination switch further includes a lever protruding laterally from between the main body and the frame. At the center of the top face of the main body, there are provided a plurality of fixed contacts for the push switch section, and at a position upwardly of the fixed contacts, there is provided an electrode plate that is elastically deformable with a pressing force to render a fixed electrode conductive. At positions equidistant from the center of the top face of the main body, there are provided the plurality of fixed contacts for the rotary switch section. There is provided a ring-shaped bush having a plurality of contact shoes contactable with the fixed contacts and this bush is operably coupled with a lever.

With the above-described construction, when a pressing operation is effected to the push switch section, the electrode plate is elastically deformed, so that the fixed electrode is rendered conductive, thus detecting this pressing operation. Whereas, when a rotary (or pivotal) operating force is applied to the lever, the contact shoes of the brush come into selective contact with the fixed electrode for the rotary switch, so that the rotary operating force can be detected in two steps, one being in the clockwise rotational direction, the other being in the counter-clockwise rotational direction.

With this combination switch disclosed in the Japanese Patent Application "Kokai" No. 2008-177098, as the fixed contacts for the rotary switch in particular, there are provided one common contact and two fixed contacts for the detecting of the clockwise rotation and for the counterclockwise rotation, respectively. On the other hand, the brush includes four contact shoes for the ring-shaped fixed portion, these four contact shoes corresponding to the two individual contacts for the detection of the clockwise rotation and the two individual contacts for the detection of the counterclockwise rotation.

With the above-described construction, when the brush is rotated clockwise from the neutral position, relative to the two individual contacts provided for detection of clockwise rotation, the associated contact shoes come into contact one after another and one of the contact shoes provided for the detection of the counter-clockwise rotation is maintained under contact with the common contact. Conversely, when the brush is rotated counter-clockwise from the neutral position, relative to the two individual contacts provided for detection of counter-clockwise rotation, the associated contact shoes come into contact one after another and one of the contact shoes provided for the detection of the clockwise rotation is maintained under contact with the common contact. In this way, the rotational operation of the lever can be detected in the two steps for the clockwise rotation and the counter-clockwise rotation, respectively.

With the combination switch disclosed in the Japanese Patent Application "Kokai" No. 2008-177098, four contact shoes are formed for the brush and the plurality of fixed contacts (i.e. the individual contacts and the common contact) are disposed at the positions corresponding respectively thereto. As such, the plurality of fixed contacts are arranged over a large cylindrical area relative to the rotational center. Further, for enabling the rotational angle of the rotary operation by an appropriate pitch, the distance between adjacent fixed contacts (the peripheral distance relative to the center) needs to be set at a relatively large value. For these reasons, the fixed contacts are disposed in distribution over the large cylindrical area, thus making it difficult to form the combination switch compact.

In view of the above, the object of the present invention is to form compact the combination switch capable of detecting a pressing operation and capable of detecting also a rotational operation in two directions, one in a predetermined direction, the other in the direction opposite thereto.

SUMMARY OF THE INVENTION

According to the characterizing feature of the present invention, there is provided a combination switch including a push switch section having a contact plate elastically deformable with a pressing operation and a contacted point that enters into an electrically conductive state upon contact with the contact plate, the push switch section being configured to detect the pressing operation, and a rotary switch section having a brush unit comprised of a rotary conductive member rotatable about an axis with a lever operation and a plurality of contact shoes formed on the rotary conductive member and a plurality of fixed contacts electrically conductive with the plurality of contact shoes, the rotary switch section being configured to detect a rotary operation;

wherein said contact shoes of the brush unit include a pair of main contact shoes formed adjacent on a same circle about said axis and a single auxiliary contact shoe;

wherein said fixed contacts include a main contact with which said pair of main contact shoes come into contact simultaneously when said brush unit is set under a neutral posture, a pair of first contacts spaced apart from each other across said auxiliary contact shoe in the rotational direction of the brush unit, and a pair of second contacts spaced apart from each other across said main contact in the rotational direction of the brush unit; and wherein said contact shoes and said fixed contacts are arranged such that;

when the brush unit is rotated in a first rotational direction from the neutral posture to a first position, one of the pair of main contact shoes located upstream in the first rotational direction comes into contact with said main contact and also said auxiliary contact shoe comes into contact with one of the pair of first contacts located downstream in the first rotational direction, and, when the brush unit is further rotated in the first rotational direction to a second position, the one of the pair of main contact shoes located upstream in the first rotational direction comes into contact with said main contact and also the other of the pair of main contact shoes located downstream in the first rotational direction comes into contact with the one of the pair of second contacts located downstream in the first rotational direction;

when the brush unit is rotated in a second rotational direction opposite to the first rotational direction from the neutral posture to a third position, one of the pair of main contact shoes located upstream in the second rotational direction comes into contact with the main contact and also the auxiliary contact shoe comes into one of the pair of first contacts located downstream in the second rotational direction, and when the brush unit is further operated in the second direction to a fourth position, one of the pair of main contact shoes located upstream in the second rotational direction comes into contact with the main contact and also one of the pair of main contact shoes located downstream in the second direction comes into with one of the pair of second contacts located downstream in the second rotational direction.

With the above construction, detection of a pressing operation is possible at the push switch section. Further, as the fixed contacts, there are provided five contacts in total, i.e. the single main contact, the one pair of first contacts and the one pair of second contacts. And, as the contact shoes of the brush unit, there are provided three contact shoes in total, i.e. the one pair of main contact shoes and the single auxiliary contact shoe. That is, the construction requires only three contact shoes. So, there is no need to dispose the contacts associated therewith in distribution over a large area in the same perimeter about the rotational axis. Hence, detection of rotational operation is possible with reduction in the disposing space for the fixed contacts. As a result, it has become possible to form compact the combination switch capable of detecting a pressing operation and capable of detecting also a rotational operation in two directions, one being in a predetermined direction, the other being in the direction opposite thereto.

According to one preferred embodiment of the present invention, the one pair of main contact shoes and the single auxiliary contact shoe are provided in one area of the brush unit relative to the axis and the lever is provided in the other area of the brush unit relative to the same. This arrangement allows for even more compact formation of the combination switch.

According to a further preferred embodiment of the present invention, there is provided a switch main body for supporting the fixed contacts, and said switch main body includes an open portion where said lever is disposed and three straight lateral walls from which there protrude a lead terminal in electric conduction with said main contact, lead terminals in electric conduction with said one pair of first contacts and lead terminals in electric conduction with said one pair of second contacts. In mounting such combination switch, it is reasonable to arrange the lead terminals in electric conduction with the total five contacts, i.e. the single main contact, the one pair of first contacts and the one pair of second contacts, as the fixed contacts in an area different from the area where the lever projects. From this point of view, according to the above-described arrangement, the total five contacts, i.e. the single main contact, the one pair of first contacts and the one pair of second contacts, can be arranged on the opposite side to the area where the lever projects. So, this arrangement allows for reasonable designing.

BRIEF DESCRIPTION OF THE DRAWINGS

FIG. 1 is a perspective view of a combination switch,

FIG. 2 is an exploded perspective view of the combination switch,

FIG. 3 is a side view showing a portion of the combination switch including a lever, FIG. 4 is a section view showing a portion of the combination switch perpendicular to the lever, FIG. 5 is a plane view showing a construction of a brush unit and arrangement of fixed contacts, FIG. 6 is a view showing relationship between a brush unit under its neutral posture and the fixed contacts, FIG. 7 is a view showing relationship between the brush unit and the fixed contacts at a first counter-clockwise operational position ("first position"), FIG. 8 is a view showing relationship between the brush unit and the fixed contacts at a second counter-clockwise operational position ("second position"), FIG. 9 is a view showing between the brush unit and the fixed contacts at a first clockwise operational position ("third position"), and FIG. 10 is a view showing between the brush unit and the fixed contacts at a second clockwise operational position ("fourth position").

DETAILED DESCRIPTION OF THE PREFERRED EMBODIMENT

Next, an embodiment of the present invention will be described with reference to the accompanying drawings.

[Basic Construction]

As shown in FIG. 1, a combination switch according to the present embodiment includes, within a case C, a push switch section P and a rotary switch section R. The push switch section P is capable of detecting a pressing operation in two steps. And, the rotary switch section R is capable of detecting, relative to a neutral posture N, two steps of rotary operations rotated counterclockwise (an example of "first rotational direction" in the present invention) about an axis X, i.e. one at a first counter-clockwise operational position L1 (an example of "first position" in the present invention) the other at a second counter-clockwise operational position L2 (an example of "second position" in the present invention) and detecting also two further steps of rotary operations rotated clockwise (an example of "second rotational direction" in the present invention) about the axis, i.e. one at a third clockwise rotational position R1 (an example of "third position" in the present invention) and the other at a fourth clockwise rotational position R2 (an example of "fourth rotational position" in the present invention). This combination switch can be provided e.g. at a shutter button portion of a digital camera. Referring to one exemplary operational mode thereof, in response to one step amount of rotary operation of the rotary switch section R from the neutral posture N, a zooming lens is operated to the telephoto side. In response to an operation of the same further to the second step, the lens operation to the telephoto side is effected at a high speed. Further, in response to one step operation thereof in the opposite direction from the neutral posture N, the zooming lens is operated to the wide-angle side. In response to an operation of the same further to the second step, the lens operation to the wide-angle side is effected at a high speed. Whereas, in response to one step operation of the push switch section P, there is realized a transition operation to the stand-by condition for a photography such as a focusing operation or an exposure setting operation. In response to an operation of the same further to the second step, there is realized an operation for starting photographing such as a shutter operation in the still photography mode or a video shooting operation in the movie mode.

Incidentally, according to an alternative operational mode of the rotary switch section R, in response to one step rotary operation to one side from the neutral posture N, the camera is activated (power-ON). In response to a rotary operation further to the second step, the still photography mode is selected. And, in response to one step of rotary operation to the other side from the neutral posture N, the camera is activated (power-ON), and in response to a rotary operation further to the second step, the movie mode is selected.

As shown in FIGS. 1-4, this combination switch includes a switch main body 10 formed of a resin of an insulating material, a lower switch plate 30 (an example of "contact plate") formed of a conductive material, an upper switch plate 40 formed of a conductive material, a flexibly deformable protective sheet 50, a brush unit 60 in the form of a ring formed of conductive material, a rotor 70 with a lever 72 integrally formed therewith, and a cover 80 formed of a metal plate or a resin plate. In the meantime, the switch main body 10 and the cover 80 together constitute the case C of the combination switch.

Although the combination switch of the invention is not limited to the use under the posture illustrated in FIG. 1, in the following discussion, the switch main body 10 will be designated as the lower side and the cover 80 will be designated to as the upper side, respectively, as shown.

[Switch Main Body]

The switch main body 10 is an integral assembly comprised of a bottom wall portion 11 having a plurality of fixed contacts 20, an outer wall portion 12 projecting upward from the outer peripheral portion of the bottom wall portion 11, a pair of rib-like portions 13 supporting the brush unit 60 from its underside, and a pair of retaining projections 14 engageable with the protective sheet 50 mentioned above. The outer wall portion 12 is formed like a wall projecting upward from the bottom wall portion 11, and at a portion of this outer wall portion 12 in its plane view, there is formed an open portion W where a lever 72 is disposed.

Further, of the outer wall portion 12, a portion thereof adjacent the open portion W and a further portion thereof opposed to the open portion W across the axis, straight lateral walls 15 are formed. Further, at the open portion W, there is formed an arcuate guide wall 16 formed about the axis X as its center. And, at opposed ends of this guide wall 16, there are formed a pair of inclined walls 17 inclined relative to the corresponding lateral walls 15 as seen in the plane view. Thus, the outer contour of the outer wall portion 12 has an approximate square shape having one side thereof cutaway, consisting of the three lateral walls 15 and the one pair of inclined walls 17. And, in the outer faces of the three lateral walls 15 and the pair of inclined walls 17, engaging projections 18 are formed integrally therewith.

As described above, the outer wall portion 12 is provided in the form of a wall projecting upward from the bottom wall portion 11 and includes, except for the area thereof corresponding to the open portion W, an inner peripheral face 12S which is formed circular about the axis X as its center. Further, the rib-like portions 13 are a pair of molded members respectively projecting upward in the form of a band from the bottom wall portion 11 and formed arcuate about the axis X.

As shown in FIG. 5, the fixed contacts 20 formed in the bottom wall portion 11 include, as constituting members of the push switch section P, a center contact 21 (an example of "a contacted contact" in the present invention) disposed on the axis X, a lower contact 22 disposed on the outer peripheral side, and an upper contact 23 disposed on the further outer peripheral side than the lower contact 21. The fixed contacts 20 also include, as constituting members of the rotary switch section R, a main contact 24 disposed on a virtual circle about the axis X, a left first contact 25L and a right first contact 25R which are disposed side by side in the peripheral direction at positions spaced from the main contact 24 on this virtual circle, and a left second contact 26L and a right second contact 26R which are disposed at positions opposed to each other across the main contact 24 on the virtual circle.

It is understood that the "fixed points" 20 comprise the generic concept inclusive all of the center contact 21, the lower contact 22, the upper contact 23, the main contact 24, the left first contact 25L, the right first contact 25R, the left second contact 26L and the right second contact 26R. And, these fixed points, namely, the center contact 21, the lower contact 22, the upper contact 23, the main contact 24, the left first contact 25L, the right first contact 25R, the left second contact 26L and the right second contact 26R are formed as metal plates or metal foils made of copper alloy or the like fixed to the upper face of the bottom wall portion 11. And, lead terminals 21T, 22T, 23T, 24T, 25LT, 25RT, 26LT, 26RT electrically connected to these contacts by such technique as printed wiring are formed so as to project outward from the three lateral walls 15. Incidentally, the reference marks denoting these lead terminals comprise the reference numerals of the respective fixed contacts to which the respective lead terminals are electrically connected, with addition of the letter "T" thereto.

As shown in FIG. 5, the main contact 24, the left first contact 25L, the right first contact 25R, the left second contact 26L and the right second contact 26R are arranged at positions excluding the fan-shaped area extending in the area of the open portion W relative to the axis X.

[Switch Plate]

A lower switch plate 30 is formed of a disc of conductive material such as copper that is elastically deformable. And, this plate 30 includes a lower plate body 31 in the form of a dome having an upwardly projecting center, and a pair of lower projections 32 projecting outward from the outer periphery of the lower plate body 31. Further, like the lower switch plate 30, an upper switch plate 40 also is formed of a disc of conductive material such as copper that is elastically deformable and includes an upper plate body 41 in the form of a dome having an upwardly projecting center, and four upper projections 42 projecting outward from the outer periphery of the upper plate body 41.

As will be detailed later, the lower switch plate 30 and the upper switch plate 40 are disposed one above the other, in a spaced relationship with each other by a set distance therebetween. When a pressing force is applied to the push switch section P, the upper switch plate 40 is elastically deformed to come into contact with the upper face of the lower switch plate 30, so that this contact condition can be electrically detected. When a further pressing force is applied, the lower switch plate 30 is elastically deformed, so that this lower switch plate 30 comes into contact with the center contact 21, so this contact condition can be electrically detected.

With the above-described operations, the push switch section P is configured to be capable of detecting two steps of pressing operation. Incidentally, in order to allow confirmation of the first step operation and the second step operation distinctly from each other with finger feel, the deformation property is set so as to obtain different click feels, the feel of the first step operation and the feel of the second step operation, and the operation reaction force dropping significantly near the completion of the operation. For this reason, it is conceivable to form at least one of the lower switch plate 30 and the upper switch plate 40 of a material such as steel which is largely elastically deformable. Further, when steel material is used, gold plating may be provided on its opposed faces for obtaining better electric conduction.

[Protective Sheet]

The protective sheet 50 includes a circular sheet body 51 formed of a flexibly deformable sheet resin material that has electrical insulating property and has a smooth surface with low friction coefficient, a central bulging portion 52 projecting upward with a curve, and cutout portions 53 formed at two positions in the outer periphery. As the retaining projections 14 come into engagement with the cutout portions 53 at the two positions, the protective sheet 50 is prevented from being rotated and is fixed in position at the same time.

[Brush Unit]

The brush unit 60, as shown in FIG. 5, includes a ring-shaped portion 61 (an example of "a rotary member") formed of a metal plate of conductive material such as copper alloy, a left main contact shoe 62 projecting downward from a leading end of a left main arm portion 62A formed integral with the ring-shaped portion 61, a right main contact shoe 63 projecting downward from a leading end of a right main arm portion 63A, an auxiliary contact shoe 64 projecting downward from a leading end of one auxiliary arm portion 64A formed integral with the ring-shaped portion 61, and a pair of engaging recesses 65. With this brush unit 60, the outer peripheral diameters of the left main portion 62A, the right main arm portion 63A and the auxiliary arm portion 64A are set to be slightly smaller than the inner diameter of the inner peripheral face 12S of the outer wall portion 12, so that the brush unit 60 is supported to the switch main body 10 to be rotatable about the axis X.

This brush unit 60 is supported at a position where the lower face side of the ring-shaped portion 61 is placed on the protective sheet 50 at portions in the upper faces of the pair of rib-like portions 13. Further, as the two left main arm portions 62A, the right main arm portion 63A and the auxiliary arm portion 64A are formed with the inclination projecting downward from the ring-shaped portion 61, the left main contact shoe 62, the right main contact shoe 63 and the auxiliary contact shoe 64 are caused to project downward.

The left main contact shoe 62 and the right main contact shoe 63 are arranged at positions adjacent to each other in the peripheral direction and at a position distant therefrom, the single auxiliary contact shoe 64 is provided. Incidentally, these contact shoes are arranged on the virtual circle centering about the axis X.

[Rotor]

The rotor 70 includes a ring-shaped rotor body 71 formed of an insulating material such as resin and a lever 72 formed integral with the rotor body 71. And, in the lower face of the rotor 70, there are formed projections (not shown) engageable into the engaging recesses 65 of the brush unit 60. As the outer peripheral diameter of this rotor body 71 is set slightly smaller than the inner diameter of the inner peripheral face 12S of the outer wall portion 12 of the switch body 10, the rotor 70 is supported to the switch body 10 to be rotatable about the axis X.

Adjacent a portion in the outer periphery of the rotor body 71 where the lever 72 is formed, there is formed a small-diameter area 71A having a reduced outer diameter. Therefore, rotation of the rotor 70 is allowed, without being restricted by the pair of inclined walls 17 at this small-diameter area 71A.

[Cover]

The cover 80 includes a cover body 81 having a shape substantially in agreement with that of the switch body 10 as seen in the plane view and forms, at five positions in the outer periphery thereof, projecting pieces 82 defining engaging holes 83. Further, at the center of the cover body 81, an aperture 84 is formed and a pressing piece 85 is formed to project downward from this aperture 84.

With the above-described construction, the center contact 21, the lower contact 22, the upper contact 23, the lower switch plate 30, and the upper switch plate 40 together constitute the push switch section P. Further, the main contact 24, the one pair of first contacts 25R, 25L, the one pair of second contacts 26R, 26L, and the two left main contact shoes 62, the right main contact shoe 63 and the one auxiliary contact shoe 64 of the brush unit 60 and the rotor 70 operated by the lever 72 together constitute the rotary switch section R.

[Construction of Combination Switch]

For assembling the combination switch, to the switch body 10, the lower switch plate 30, the upper switch plate 40, the protective sheet 50, the brush unit 60, the rotor 70 and the cover 80 are superposed one on another, respectively, and the cover 80 is pressed relative to the switch body 10, in the direction along the axis X. With these, a plurality of projecting pieces 82 of the cover 80 are elastically deformed to the outer side, and the plurality of engaging projections 18 of the switch body 10 come into engagement with the engaging holes 83 of these projecting pieces 82, so that by the elastic resilience of the projecting pieces 82, the engaged condition of the engaging projections 18 relative to the engaging holes 83 is maintained. Under this assembled condition, as shown in FIG. 3 and FIG. 4, upon engagement of the lower projections 32 of the lower plate body 31 with the bottom wall portion 11, the outer peripheral portion of this lower plate body 31 comes into contact with the lower contact 22, thus establishing electric conduction. Also, upon engagement between the upper projections 42 (see FIG. 2) of the upper plate body 41 with the bottom wall portion 11, these upper projections 42 come into contact with the upper contacts 23, thus establishing electric conduction. Further, the lower plate body 31 and the upper plate body 41 are arranged in the positional relationship of being vertically spaced apart from each other by a predetermined distance, and the bulging portion 52 of the sheet body 51 of the protective sheet 50 covers the upper face of the upper plate body 41 and the outer peripheral portion of this cover body 51 is placed in contact with the upper faces of the pair of rib-like portions 13.

As the cutout portions 53 of this sheet body 51 come into engagement with the retaining projections 14, the protective sheet 50 is fixed in position and its rotation is restricted at the same time. On the upper face of the outer peripheral portion of this sheet body 51, the ring-shaped portion 61 of the brush unit 60 is supported. And, the two left main contact shoes 62, the right main contact shoe 63 and the one auxiliary contact shoe 64 of this brush unit 60 come into contact with the main contact 24, the left first contact 25L, the right first contact 25R, the left second contact 26L, and the right second contact 26R associated therewith, respectively (the mode of this contact will be detailed later).

As the rotor body 71 of the rotor 70 comes into contact with the upper face of the brush unit 60 and the projections (not shown) of this rotor body 71 come into engagement with the engaging recesses 65 of the brush unit 60, the brush unit 60 is rotated together with a rotational operation on the lever 72. And, under this assembled condition, the two steps of pressing operation are possible by the push switch section P, as described above. Further, at the rotary switch section R, two steps of detection, in the counter-clockwise and clockwise rotations of the lever 72 relative to the neutral posture N are possible.

As the rotor body 71 comes into contact with the lower face of the cover 80, separation between the rotor body 71 and the brush unit 60 is restricted. And, the pressing piece 85 at the aperture 84 of the cover 80 serves to restrict floating displacement of the sheet body 51.

[Modes of Detection]

With the above combination switch in operation, when a pressing force is applied through the aperture 84 of the cover 80, the bulging portion 52 of the protective sheet 50 is flexibly deformed, so that the center portion of the upper plate body 41 of the upper switch plate 40 is elastically deformed to be depressed downward. With this elastic deformation, the lower face of this center portion comes into contact with the center portion of the lower plate body 31 of the lower switch plate 30, whereby electric conduction is established between the upper contact 23 and the lower contact 22, hence, the detection of operation to this first stage is made possible.

With continuation of the above pressing operation, the pressing operational force is applied from the center portion of the upper plate body 41 to the center portion of the lower plate body 31, so that the center portion of the lower plate body 31 is elastically deformed to be depressed downward. With this elastic deformation, the lower face of this center portion comes into contact with the center contact 21, whereby electric conduction is established between the lower contact 22 and the center contact 21, hence, detection of operation to this second stage is made possible.

With this combination switch, relative to the neutral posture N, the lever 72 can be operated to a first right operational position R1 and to a second right operational position R2. Similarly, the lever 72 can be operated to the left side, to a first left operational position L1 and to a second left operational position L2.

When the lever 72 is located at the neutral posture N, as shown in FIG. 6, the left main contact shoe 62 and the right main contact shoe 63 are in contact with the main contact 24, thus being in electric conduction therewith. On the other hand, the auxiliary contact shoe 64 is located at an intermediate position between the left first contact 25L and the right first contact 25R, being not in contact with either of these.

Relative to this neutral posture N, if the lever 72 is pivotally operated to the first left operational position L1, as shown in FIG. 7, while at least the right main contact shoe 63 is kept in contact with the main contact 24, the auxiliary contact shoe 64 comes into contact with the left first contact 25L, whereby a same electric potential is established between this left first contact 25L and the main contact 24. Further, if the lever 72 is pivotally operated to the second left operational position L2, as shown in FIG. 8, while the right main contact shoe 63 is kept in contact with the main contact 24, the left main contact shoe 62 comes into contact with the left second contact 26L, whereby a same electric potential is established between this left second contact 26L and the main contact 24.

Conversely to the above, relative to the neutral posture N, if the lever 72 is pivotally operated to the first right operational position R1, as shown in FIG. 9, while at least the left main contact shoe 62 is kept in contact with the main contact 24, the auxiliary contact shoe 64 comes into contact with the right first contact 25R, whereby a same electric potential is established between the right first contact 25R and the main contact 24. If the lever 72 is further pivotally operated to the second right operational position R2, as shown in FIG. 10, while the left main contact shoe is kept in contact with the main contact 24, the right main contact 63 comes into contact with the right second contact 26R, whereby a same electric potential is established between this right second contact 26R and the main contact 24.

That is, when the brush unit 60 is rotated counter-clockwise from the neutral posture N, while the right main contact shoe 63 is kept in contact with the main contact 24, the auxiliary contact shoe 64 comes into contact with the left first contact 25L. When the unit 60 is further rotated, while the right main contact shoe 63 is kept in contact with the main contact 24, the left main contact shoe 62 comes into contact with the one pair of left second contacts 26L.

Conversely to the above, when the brush unit 60 is rotated clockwise from the neutral posture N, while the left main contact shoe 62 is kept in contact with the main contact 24, the auxiliary contact shoe 64 comes into contact with the right first contact 25R. When the unit 60 is further rotated, while the left main contact shoe 62 is kept in contact with the main contact 24, the right main contact shoe 63 comes into contact with the right second contact 26R.

With this combination switch, according its assumed mode of use, the main contact 24 is set to the ground-level potential. And, by identifying a fixed contact 20 whose potential has dropped to the ground level, the switch operation is detected. Instead, however, a desired potential may be impressed to this main contact 24. In this alternative case, a switch operation will be detected as a rise in the potential of the fixed contact 20.

In this way, according to the combination switch proposed by the present invention, when a pressing operation is effected to the push switch section P, two steps detection with click feels corresponding to the respective strokes of the pressing operation are made possible. Further, if a rotational operation is effected to the rotary switch section R, two steps detection corresponding to the stroke of the rotational operation in the two opposite directions relative to the neutral posture N are made possible.

In particular, at the rotary switch section R, relative to the neutral posture N, the rotational operation to one side (e.g. to the left side) is detected in two steps and the rotational operation to the other side (e.g. to the right side) is detected in two steps. With these, rotational operations to the fourth positions (postures) are made possible, even excluding the detection of the neutral posture N. Yet, the construction requires only three contact shoes to be formed in the outer periphery of the brush unit 60. In comparison with e.g. an arrangement having four contact shoes in correspondence with four postures, it is possible to realize compactness of the brush unit 60 and to reduce the area where the contacts to come into contact with the contact shoes are disposed. So that, the compactness of the combination switch can be realized.

The present invention can be used in not only a digital camera, but also in audio devices and mobile phones.

The invention claimed is:

1. A combination switch including a push switch section having a contact plate elastically deformable with a pressing operation and a contacted point that enters into an electrically conductive state upon contact with the contact plate, the push switch section being configured to detect the pressing operation, and a rotary switch section having a brush unit comprised of a rotary conductive member rotatable about an axis with a lever operation and a plurality of contact shoes formed on the rotary conductive member and a plurality of fixed contacts electrically conductive with the plurality of contact shoes, the rotary switch section being configured to detect a rotary operation;

wherein said contact shoes of the brush unit include a pair of main contact shoes formed adjacent on a same circle about said axis and a single auxiliary contact shoe;

wherein said fixed contacts include a main contact with which said pair of main contact shoes come into contact simultaneously when said brush unit is set under a neutral posture, a pair of first contacts spaced apart from each other across said auxiliary contact shoe in the rotational direction of the brush unit, and a pair of second contacts spaced apart from each other across said main contact in the rotational direction of the brush unit; and wherein said contact shoes and said fixed contacts are arranged such that;

when the brush unit is rotated in a first rotational direction from the neutral posture to a first position, one of the pair of main contact shoes located upstream in the first rotational direction comes into contact with said main contact and also said auxiliary contact shoe comes into contact with one of the pair of first contacts located downstream in the first rotational direction, and, when the brush unit is further rotated in the first rotational direction to a second position, the one of the pair of main contact shoes located upstream in the first rotational direction comes into contact with said main contact and also the other of the pair of main contact shoes located downstream in the first rotational direction comes into contact with the one of the pair of second contacts located downstream in the first rotational direction;

when the brush unit is rotated in a second rotational direction opposite to the first rotational direction from the neutral posture to a third position, one of the pair of main contact shoes located upstream in the second rotational direction comes into contact with the main contact and also the auxiliary contact shoe comes into one of the pair of first contacts located downstream in the second rotational direction, and when the brush unit is further operated in the second direction to a fourth position, one of the pair of main contact shoes located upstream in the second rotational direction comes into contact with the main contact and also one of the pair of main contact shoes located downstream in the second direction comes into with one of the pair of second contacts located downstream in the second rotational direction.

2. The combination switch according to claim 1, wherein the one pair of main contact shoes and the single auxiliary contact shoe are provided in one area of the brush unit relative to the axis and the lever is provided in the other area of the brush unit relative to the same.

3. The combination switch according to claim 2, further comprising a switch main body for supporting the fixed contacts, and wherein said switch main body includes an open portion where said lever is disposed and three straight lateral walls from which there protrude a lead terminal in electric conduction with said main contact, lead terminals in electric conduction with said one pair of first contacts and lead terminals in electric conduction with said one pair of second contacts.

* * * * *